United States Patent [19]

Stipe

[11] Patent Number: 4,563,845

[45] Date of Patent: Jan. 14, 1986

[54] ATTIC STAIRWAY INSULATING AND SEALING DEVICE

[76] Inventor: James J. Stipe, P.O. Box 428, Highlands, Tex. 77562

[21] Appl. No.: 616,253

[22] Filed: May 30, 1984

[51] Int. Cl.[4] ..... E06B 5/00

[52] U.S. Cl. ..... 52/202; 52/204

[58] Field of Search ..... 521/19, 400, 404, 407, 521/802, 803, 804, 785, 203, 202, 21, 204

[56] References Cited

U.S. PATENT DOCUMENTS

| | | | |
|---|---|---|---|
| 1,997,605 | 4/1935 | Strom et al. | 52/407 |
| 2,072,328 | 3/1937 | Gilpin | 52/19 |
| 2,299,908 | 10/1942 | Leash | 52/406 |
| 2,582,144 | 1/1952 | Miles | 52/404 |
| 3,364,639 | 1/1968 | Davenport | 52/407 |
| 4,299,059 | 11/1981 | Smith | 49/401 |
| 4,423,574 | 1/1984 | Pierre | 52/202 |

FOREIGN PATENT DOCUMENTS

| | | | |
|---|---|---|---|
| 2003717 | 8/1970 | Fed. Rep. of Germany | 52/406 |
| 2420548 | 11/1975 | Fed. Rep. of Germany | 52/202 |

*Primary Examiner*—John E. Murtagh
*Assistant Examiner*—Caroline Dennison
*Attorney, Agent, or Firm*—Harvey B. Jacobson

[57] ABSTRACT

Energy saving attachments for insulating attic access openings in the ceilings of houses or other buildings comprise insulating panels which attach from below to the outside of a swing-down door which closes the access opening, or to the ceiling around the access opening. The panels, which may be fitted to existing attic door installations, do not impede access to the attic, nor do they impede operation of the door or a folding stairway when such is carried by the door.

6 Claims, 5 Drawing Figures

ATTIC STAIRWAY INSULATING AND SEALING DEVICE

BACKGROUND OF THE INVENTION

This invention relates to energy savings attachments for use in connection with attic stairway openings and the like.

The compelling need to practice stringent energy conservation in recent years has led to significant improvements in the thermal efficiency of houses and other domestic buildings. Attic spaces, where a considerable amount of heat loss occurs, are generally insulated, but the areas immediately above an attic access opening (which may be fitted with a fold-away, pull-down stairway structure) are not normally insulated, in order to facilitate access to the attic.

The thermal resistance of conventional hidden folding attic stairway structures, for example, is low because such structures generally consist predominantly of plywood, hardwood, and metal. Also, it is difficult to ensure a tight fit around the outer periphery of a door carrying the stairway due to the complex design of the structure. Accordingly, energy losses through attic openings due both to conduction and convection can be considerable. The present invention addresses itself to the problem of such energy losses and the provision of convenient means for reducing same.

STATEMENT OF PRIOR ART

Previous proposals for reducing energy losses through attic stairway openings, for example, have included attempts to improve the construction of the attic door itself, or in insulating the area immediately above the stairwell by placing a large box-like device over the stair assembly in the attic. The former approach does not address the problem of existing stair units already installed, and requires a specialized form of door structure to be incorporated in the manufacturing process itself. The latter approach requires a user to lift and move aside a relatively awkward device when reaching the top of the stairway before access can be obtained to the attic. Examples of such previous proposals are disclosed in the following U.S. Pat. Nos.: 3,807,528; 4,151,894; 4,299,059; 4,312,423.

SUMMARY OF THE INVENTION

In accordance with the present invention, an energy saving attachment for use in connection with an attic access opening and the like comprises an insulating panel structure which is attached from below either directly to the outside of an attic door, or in removable manner to the ceiling around the access opening. The panel structure may conveniently comprise a box or tray-like support element with suitable attachment means for securing same to the door or ceiling, and lightweight insulating material, which may be in sheet form, within the support element. Various forms of securement means may be used in connection with the panel structures to suit different types of attic door and doorways.

Attachments in accordance with the invention are energy saving devices which may be easily and quickly attached to existing attic doors or access openings from the living area below, and which do not impede access to the attic when the door is opened. The attachments are designed to improve the thermal resistance of conventional attic doors and fold-away stairway structures, to reduce airflow between the attic and the living area of a building, to reduce sound transmission through attic doorway openings, to have an unobtrusive appearance as viewed from the living area, and to be readily and simply installed without the need for skilled labor or specialized tools.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
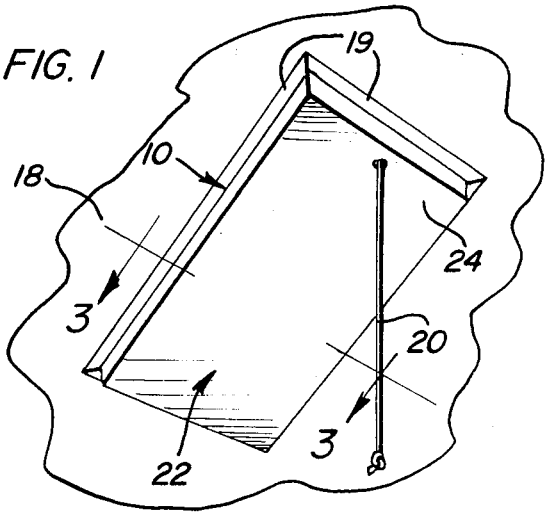
FIG. 1 is a perspective view from below of a swing-down attic door fitted with an energy saving attachment in accordance with the invention.
Figure 2:
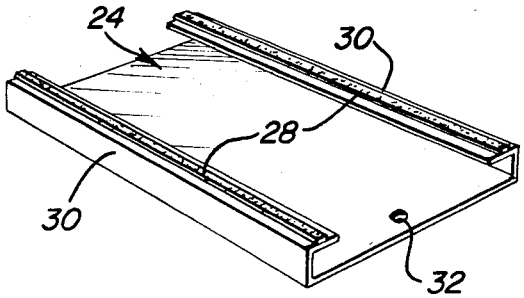
FIG. 2 is a perspective view of a support element part of the attachment.
Figure 3:
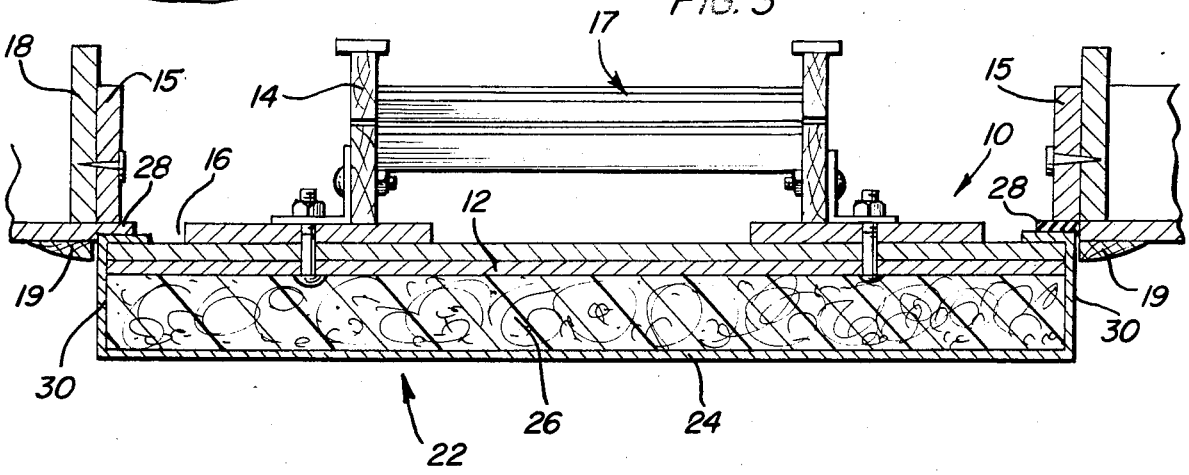
FIG. 3 is an enlarged sectional view on line 3—3 of FIG. 1.

Referring initially to FIGS. 1–3, a swing-down attic door 10 having an outer panel 12 (which may be of plywood or the like) and a support frame 14, for a folded stairway structure 17 is suitably hinged by known means, not shown, in an opening 16 of a ceiling structure 18 forming an access opening to an attic space above the ceiling. It will be understood that the door 10 may be an existing, already installed attic door, which may carry a conventional, fold-away stairway structure. Frame members 15 may be attached to the ceiling structure around opening 16. In this embodiment, it will be noted that the edges of door panel 12 almost meet the edges of the ceiling defining opening 16. Door 10 has a pull cord 20 adjacent one edge opposite the edge by which the door is hinged. The ceiling is provided with trim strips 19 around opening 16.

In accordance with the invention, door 10 is provided with an energy saving attachment in the form of an insulated panel structure 22 comprising an outer box or tray-like support element 24 and thermal insulation material 26 (FIG. 3) contained therewithin. Support element 24 may be formed from a lightweight rigid material such as aluminum or plastic, and may have channel-like flanges 30 along its opposite longitudinal edges. The upper faces of the flanges may have resilient thermally insulating sealing strips 28 secured therealong. Insulation material 26 may comprise a plastic foam, fiberglass, or the like in sheet form, and the flange depth, depth of insulation, and thickness of door panel 12 may be interrelated to allow panel structure 22 to be slid over the door panel from one end and snugly retained thereon with the flanges gripping the respective edges of the door panel. A hole 32 is provided in support element 24 and an aligned hole (not shown) is provided in the insulation material 26 for passage of cord 20.

In use, the panel structure is easily and quickly installed on an attic door from below, and provides energy saving insulation for the attic access opening when the door is closed. Air exchange is reduced by the sealing strips 28 engaging frame members 15 as shown in FIG. 3 when the door is closed. When the door is open, the panel structure forms no impediment to attic access and the structure further provides no impediment to normal opening and closing of the door.

Figure 4:
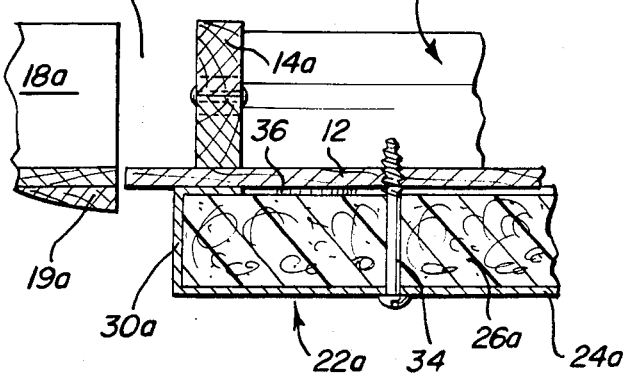
FIGS. 4 and 5 are views similar to FIG. 3 illustrating alternative forms of energy saving attachments in accordance with the invention.

The panel structure 22*a* of FIG. 4 may be modified compared with FIG. 3 by omission or removal of the sealing strips 28, and the panel structure may be secured from below to the outside of door panel 12*a* by screws 34, adhesive 36, or other suitable fastening means.

Figure 5:
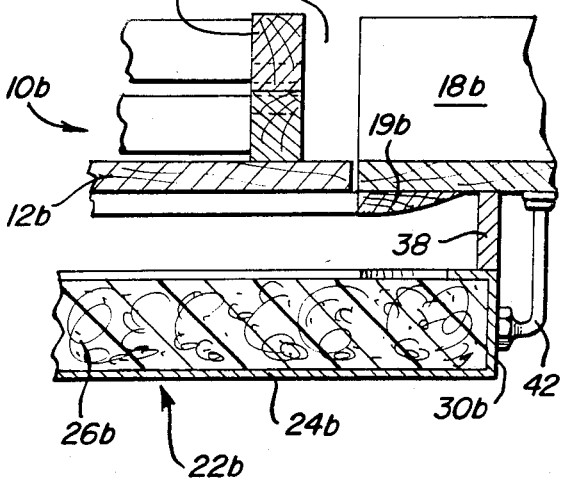

Panel structure 22*b* (FIG. 5) is of similar form to panel structures 22 and 22*a*, except that the upper surfaces of flanges 30*b* are provided with resilient strips 38 of thermal insulating material, the panel structure being dimensioned to cover an entire attic door 10*b* and surrounding trim 19*b*, and being releasably secured to ceiling 18*b* from below by suitable fixtures 42 attached to the ceiling. When it is desired to obtain access to the attic, the panel structure may be temporarily removed, and later replaced as required.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An energy saving attachment for use in insulating an attic access opening, comprising a panel structure having a box or tray-like support member specifically dimensioned substantially to cover the access opening, thermal insulating material substantially filling the support member, and means for attaching the support member from below to a swing-down door closing the access opening, wherein the support member includes channel-like flanges along opposed longitudinal sides thereof and wherein the flanges and insulating material are dimensioned for sliding the panel structure into engagement with an outer panel of the attic door with said flanges gripping opposed longitudinal edges of the door to provide the attaching means.

2. The invention of claim 1 including strips of resilient sealing material disposed along outer surfaces of the flanges for engaging edge portions of the ceiling structure surrounding the access opening.

3. In combination with an attic access opening in a ceiling having a swing door closing the opening, an energy saving attachment comprising a thermally insulating panel structure and means attaching the panel structure from below to the outer surface of the door with the panel structure projecting below the door to insulate the attic access opening when the door is closed, wherein the panel structure comprises a tray-like support member filled with insulating material, and the attaching means comprises channel-like flanges along opposed longitudinal edges of the support member which grip corresponding opposed longitudinal edges of the door when the panel structure is slid into engagement with the door.

4. The invention of claim 3 including resilient sealing strips disposed along outer surfaces of said flanges for engagement with edge portions of the ceiling surrounding the access opening.

5. The invention of claim 3 including aligned openings in the insulating material and support member for passage of a pull cord for operating the door.

6. The invention of claim 3 wherein the door carries a folding attic stairway.

* * * * *